US007756450B2

(12) United States Patent
Kurimoto et al.

(10) Patent No.: US 7,756,450 B2
(45) Date of Patent: Jul. 13, 2010

(54) TONER TRANSPORT DEVICE AND IMAGE FORMING APPARATUS

(75) Inventors: Hideaki Kurimoto, Yamatokoriyama (JP); Yasuyuki Ishiguro, Higashiosaka (JP); Mitsuhiro Murata, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 348 days.

(21) Appl. No.: 11/936,262

(22) Filed: Nov. 7, 2007

(65) Prior Publication Data

US 2008/0118277 A1 May 22, 2008

(30) Foreign Application Priority Data

Nov. 20, 2006 (JP) ..... 2006-313587

(51) Int. Cl.
*G03G 15/08* (2006.01)

(52) U.S. Cl. ..... 399/258; 399/262

(58) Field of Classification Search ..... 399/258, 399/262

See application file for complete search history.

(56) References Cited

U.S. PATENT DOCUMENTS 6,366,755 B1 4/2002 Takashima
6,608,983 B2 * 8/2003 Terazawa et al. ..... 399/258
2006/0228134 A1 * 10/2006 Ishiguro et al. ..... 399/258

FOREIGN PATENT DOCUMENTS

| | | |
|---|---|---|
| JP | 04-174467 | 6/1992 |
| JP | 04-174885 | 6/1992 |
| JP | 10-149018 A | 6/1998 |
| JP | 2000-137382 | 5/2000 |
| JP | 2004-347745 | 12/2004 |

* cited by examiner

*Primary Examiner*—Stephen D Meier
*Assistant Examiner*—G. M. Hyder
(74) *Attorney, Agent, or Firm*—Nixon & Vanderhye, PC

(57) ABSTRACT

The toner transport device of the present invention includes a toner transport pipe, internally having a toner transport path for allowing toner to pass therethrough, which is disposed so that the toner transport path extends in an up-and-down direction and which vibrates in upward and downward directions. Further, on an upper joint section and a lower joint section of the toner transport pipe are provided an upper foamed elastic member and a lower foamed elastic member which internally has a toner passage for allowing the toner transported to/from the toner transport path to pass therethrough, wherein a wall surface of the toner passage is coated with a resin layer which does not allow the toner to pass therethrough. As a result, it is possible to properly prevent retention and solidification of toner in the toner transport path by the upward-and-downward vibration of the toner transport member and it is possible to properly prevent toner from leaking from the toner transport device.

7 Claims, 6 Drawing Sheets

TONER TRANSPORT DEVICE AND IMAGE FORMING APPARATUS

This Nonprovisional application claims priority under 35 U.S.C. §119(a) on Patent Application No. 313587/2006 filed in Japan on Nov. 20, 2006, the entire contents of which are hereby incorporated by reference.

FIELD OF THE TECHNOLOGY

The present technology relates to (i) a toner transport device for transporting toner and (ii) an image forming apparatus having the toner transport device.

BACKGROUND OF THE TECHNOLOGY

Conventionally, image forming apparatuses employing an electrophotographic system such as a copier, a printer, and a facsimile machine has been widely known. In such image forming apparatuses, an electrostatic latent image is formed on a surface of a photoreceptor. The electrostatic latent image is developed with toner, and a toner image thus obtained is transferred and fixed onto a sheet such as a paper sheet or the like. The toner used to develop the electrostatic latent image is supplied from the developing device to the surface of the photoreceptor. To the developing device, toner is supplied from a toner cartridge via a toner transport device. In a structure in which a toner cartridge is disposed over a developing device, a toner transport device is provided with a toner transport path extending in an up-and-down direction.

On the other hand, in recent years, with the improvement in high image quality of image forming apparatuses, particles of toner have been designed to have a micro diameter. Toner having such micro particles generally does not have good fluidity, so that retention and solidification of toner easily occur in a toner transport path of a toner transport device. In order to overcome such a problem, a toner transport device needs some contrivances.

For example, an apparatus disclosed in patent document 1 is arranged such that an accordion pipe is used as a toner transport member constituting a toner transport path disposed in the up-and-down direction, and an outer surface of the accordion pipe is repeatedly hit so as to cause toner remaining in pleats of the inner surface of the accordion pipe to fall off. However, the toner transport member constituted of the accordion pipe, structurally, does not easily prevent retention and solidification of toner in a toner transport path.

Further, patent document 2 discloses an apparatus in which, inside a toner transport path disposed in an up-and-down direction, a spring agitator is provided that moves in upward and downward directions so as to prevent the toner from adhering to the inner wall of the toner transport path. However, this structure raises such a problem that toner easily remains and solidifies on the surface of the spring agitator.

In patent document 3, the inventors previously proposed a toner transport device which vibrates, in upward and downward directions, a toner transport member constituting a toner transport path disposed in an up-and-down direction. According to this arrangement, the whole toner transport member is evenly vibrated upward and downward, so that it is possible to properly prevent retention and solidification of toner in the toner transport path.

Incidentally, in such an arrangement that the toner transport member is vibrated in upward and downward directions, an elastic member for absorbing oscillation caused by vibration at the time of expanding and contracting operations of the toner transport member is provided on a joint section between the toner transport member and a socket thereof. Further, the elastic member requires a function for preventing toner from leaking from the joint section without hampering the upward-and-downward vibration of the toner transport member. The toner leakage causes internal taint or foggy image.

Conventionally, as such an elastic member having a toner sealing property, a member obtained by applying a synthetic leather to the elastic member is disclosed by patent document 4 for example. The elastic member is to prevent toner from leaking from an end of a cleaning blade. As the elastic member, it is preferable to use Moltplane (trade name) obtained by processing urethane rubber into a porous sponge manner. As the synthetic leather, it is preferable to use Ecsaine (trade name: product of Toray Industries) obtained by blending micro polyester fibers with polyurethane and processing the mixture into a back skin manner. In applying the elastic member with the synthetic leather, a double-face adhesive tape is used.

Further, patent document 5 discloses, as the elastic member having a toner sealing property, foamed polyurethane whose density is 20 to 40 (kg/m$^3$) and cell number is 40 to 60 (in every 25 mm). The elastic member comes into contact with a toner layer thickness restricting member of a developing device from a side opposite to a toner carrier so as to prevent toner from leaking from an end of the developing device.

Patent document 1: Japanese Unexamined Patent Publication, No. 174467/1992 (Tokukaihei 4-174467, publication date: Jun. 22, 1992)

Patent document 2: Japanese Unexamined Patent Publication, No. 296731/2001 (Tokukai 2001-296731, publication date: Oct. 26, 2001)

Patent document 3: Japanese Unexamined Patent Publication, No. 267945/2006 (Tokukai 2006-267945, publication date: Oct. 5, 2006)

Patent document 4: Japanese Unexamined Patent Publication, No. 174885/1992 (Tokukaihei 4-174885, publication date: Jun. 23, 1992)

Patent document 5: Japanese Unexamined Patent Publication, No. 137382/2000 (Tokukai 2000-137382, publication date: May 16, 2000)

SUMMARY OF THE TECHNOLOGY

In the toner transport device which has been previously proposed by the inventors and vibrates the toner transport member in upward and downward directions, it is necessary to give a toner sealing property to the elastic member disposed on the joint section between the toner transport member and the socket thereof.

Thus, the inventors tried using the aforementioned conventional elastic member having a toner sealing property, but they failed to properly prevent the toner leakage in this case. Also, this raised such a problem that it is impossible to properly prevent retention and solidification of toner in the toner transport path.

Specifically, the elastic member of patent document 5 raises such a problem that: since an average particle diameter of toner is several μm, the toner comes into bubbles of the foamed polyurethane whose cell number is 40 to 60 (in every 25 mm). The toner having come into the bubbles is solidified in the bubbles due to oscillation caused by the upward-and-downward vibration of the toner transport member, so that the elastic member less expands and contracts. This makes the elastic member harder.

The harder elastic member does not sufficiently absorb the oscillation caused by the upward-and-downward vibration of the toner transport member. Thus, it is impossible to properly prevent retention and solidification of toner in the toner transport path and it is impossible to follow the vibration of the toner transport member, so that the sealing property in the joint section drops, which results in toner leakage.

If the toner comes into the bubbles, an elastic member whose bubbles are interconnected to one another raises such a problem that the toner having come into the bubbles issues from the toner transport path to the outside due to expanding and contracting operations caused by the upward-and-downward vibration of the toner transport member.

According to the arrangement of patent document 4, the toner hardly comes into the bubbles of the elastic member, so that it is possible to suppress the toner leakage to some extent. However, the toner leakage cannot be completely prevented and leakage is confirmed.

An object is to provide (i) a toner transport device which can properly prevent retention and solidification of toner in a toner transport path which are caused by upward-and-downward vibration of a toner transport member and can properly prevent toner from leaking from the device to the outside and (ii) an image forming apparatus having the toner transport device.

In order to achieve the foregoing object, a toner transport device transports toner supplied from a toner replenishing device provided above the toner transport device to a developing device provided below the transport device, and the toner transport device includes: a toner transport member, internally having a toner transport path, which is disposed so that the toner transport path extends in an up-and-down direction and which vibrates in upward and downward directions; and an elastic member, made of a deformable foamed material, which is disposed on at least either an upper joint section or a lower joint section of the toner transport member and which internally has a toner passage for allowing the toner transported to/from the toner transport path to pass therethrough, wherein a wall surface of the toner passage in the elastic member is coated with a resin layer which does not allow the toner to pass therethrough.

With this arrangement, the toner transport member is vibrated in the upward and downward directions, so that toner passes through the toner transport path of the toner transport member without any retention. As a result, it is possible to prevent retention and solidification of toner in the toner transport path.

Further, the elastic member disposed on at least either the upper joint section or the lower joint section of the toner transport member properly seals the joint section of the toner transport member without hampering the upward-and-downward vibration of the toner transport member.

Particularly, with the aforementioned arrangement, the wall surface of the toner passage of the elastic member is coated with the resin layer which does not allow the toner to pass therethrough, so that the toner transported through the toner transport path does not come into bubbles of the elastic member made of foamed material.

The toner does not come into the bubbles, so that contractility of the elastic member is favorably kept. Thus, the elastic member can absorb oscillation caused by the upward-and-downward vibration of the toner transport member while keeping sufficient stroke. As a result, the joint section is firmly sealed, so that it is possible to properly prevent toner leakage.

Further, toner does not come into the bubbles, so that even an elastic member containing continuous bubbles interconnected to one another does not allow toner to issue from the toner transport path to the outside at the time of expanding and contracting operations of the elastic member which are caused by the upward-and-downward vibration of the toner transport member.

Further, it is most preferable that the elastic member is disposed on each of the upper side and the lower side of the toner transport member, but it is preferable to provide the elastic member at least on the lower side.

In the toner transport path disposed in the up-and-down direction, toner is likely to retain in the bottom of the toner transport member due to its free fall. Thus, by disposing at least on the lower side the elastic member whose toner sealing property is high, it is possible to effectively prevent toner leakage in the joint section.

As a result, it is possible to provide (i) a toner transport device which can properly prevent retention and solidification of toner in the toner transport path by upward-and-downward vibration of the toner transport member and can properly prevent toner from leaking from the device and (ii) an image forming apparatus having the toner transport device.

Additional objects, features, and strengths will be made clear by the description below. Further, the advantages of the present technology will be evident from the following explanation in reference to the drawings.

BRIEF DESCRIPTION OF THE DRAWINGS

FIG. 1(*a*) illustrates a state in which a shutter of the toner transport device is closed. FIG. 1(*b*) illustrates a state in which a shutter of the toner transport device is opened.

DESCRIPTION OF THE EMBODIMENTS

The present technology is applicable to an image forming apparatus, such as a copier and a printer, which is arranged so that toner is supplied from a toner replenishing device such as a toner cartridge via a toner transport device to a developing device provided below the toner replenishing device.

The following will describe one embodiment of the present technology with reference to FIG. 1 to FIG. 7. Note that, the present technology is not limited to this.

Figure 2:
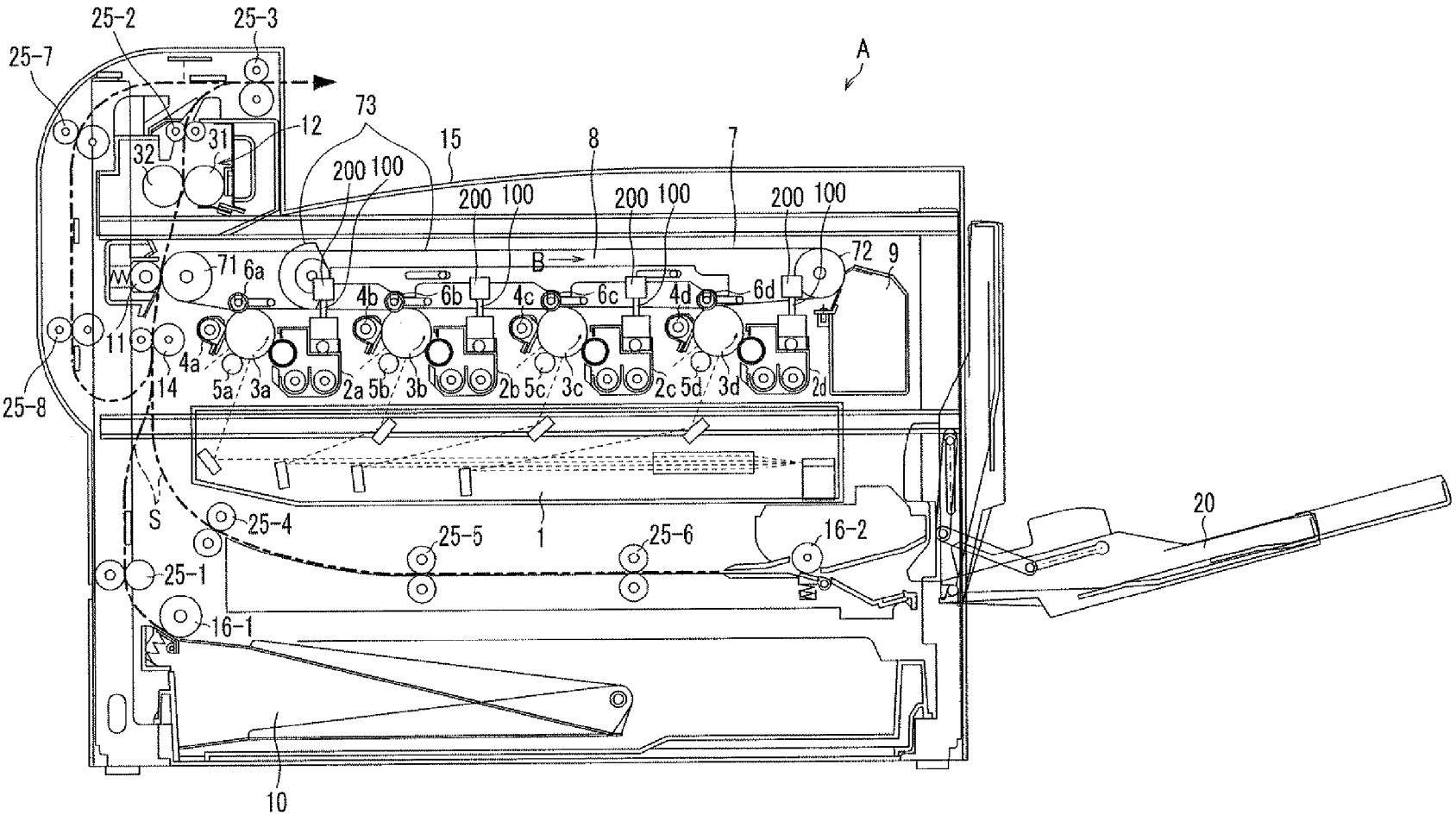
FIG. 2 is a cross sectional view illustrating a structure of an image forming apparatus having the toner transport device, illustrated in FIG. 1(*a*) and FIG. 1(*b*), which is provided on a toner supply device.

FIG. 2 is an explanatory drawing illustrating a structure of an image forming apparatus A according to the present embodiment. The image forming apparatus A forms a multi-color image or a monochrome image on a sheet (recording paper sheet), based on externally inputted image data or image data obtained by reading a document.

As illustrated in FIG. 2, the image forming apparatus A includes an exposure unit 1, developing devices 2, photosensitive drums 3, charging devices 5, cleaner units 4, an intermediate transfer belt unit 8, a fixing unit 12, a sheet transport path S, a paper feed tray 10, a paper output tray 15, and the like.

The image forming apparatus A handles image data of a color image with different colors such as black (K), cyan (C), magenta (M), and yellow (Y). Therefore, in order to realize four latent images that respectively correspond to the four colors, four sets are provided for each of the developing devices 2 (2*a*, 2*b*, 2*c*, and 2*d*), the photosensitive drums 3 (3*a*, 3*b*, 3*c*, and 3*d*), the charging devices 5 (5*a*, 5*b*, 5*c*, and 5*d*), and the cleaner units 4 (4*a*, 4*b*, 4*c*, and 4*d*). The symbols a, b, c, and d correspond to black, cyan, magenta, and yellow, respectively. With the means sorted by the symbols, four image stations are configured.

In the image stations, the photosensitive drums 3 are disposed in the upper part of the image forming apparatus A. The charging devices 5 serve to uniformly charge surfaces of the photosensitive drums 3 at a certain voltage. The charging devices 5 may be contact roller type as shown in FIG. 2, contact brush type, or charger type.

For the exposure unit 1, as illustrated in FIG. 2, a laser scanning unit (LSU) may be used which includes a laser radiation section and a reflecting mirror. Alternatively, for example, an EL or LED record head may be used in which light emitting elements are arranged in array(s). The exposure unit 1 exposes the charged photosensitive drums 3 according to inputted image data, so that electrostatic latent images corresponding to the image data are formed on the respective surfaces of the photosensitive drums 3.

The developing devices 2 cause the electrostatic latent images formed on the photosensitive drams 3 to be visualized using the toners of the colors K, C, M, and Y. The cleaner units 4 remove and collect toner remaining on the surfaces of the photosensitive drums 3 after the developing process and image transfer process are carried out.

On the photosensitive drums 3 is disposed the intermediate transfer belt unit 8. The intermediate transfer belt unit 8 includes intermediate transfer rollers 6 (6*a*, 6*b*, 6*c*, and 6*d*), an intermediate transfer belt 7, an intermediate transfer belt driving roller 71, an intermediate belt following roller 72, intermediate transfer belt tension mechanisms 73, and an intermediate belt cleaning unit 9.

The intermediate transfer rollers 6, the intermediate transfer belt driving roller 71, the intermediate transfer belt following roller 72, the intermediate transfer belt tension mechanism 73 and the like serve to stretch and drive the intermediate transfer belt 7 to rotate in a direction indicated by an arrow B.

The intermediate transfer rollers 6 are mounted on and supported by intermediate transfer roller mounting sections in the intermediate transfer belt tension mechanism 73 for rotary motion. The intermediate transfer rollers 6 serve to apply a transfer bias to transfer toner images formed on the photosensitive drums 3 onto the intermediate transfer belt 7.

The intermediate transfer belt 7 is provided so as to contact the photosensitive drums 3. On the intermediate transfer belt 7, colored toner images formed on the photosensitive drums 3 are transferred and overlapped one by one, realizing a colored toner image (multicolored toner image). The intermediate transfer belt 7 is formed to be an endless belt, using a dielectric elastic member or a dielectric film having a thickness of approximately 50 μm to 1000 μm.

Transfer operation of the toner images from the photosensitive drums 3 to the intermediate transfer belt 7 is carried out by the intermediate transfer rollers 6, which are in contact with a backside of the intermediate transfer belt 7. The intermediate transfer rollers 6 are biased with a high voltage transfer bias (a high voltage having a reverse polarity (+) with respect to a polarity (−) in which the toners are charged). Each of the intermediate transfer rollers 6 is formed on a metal axis (e.g. stainless) having a diameter of 8 mm to 10 mm, and its surface is coated with conducting elastic material (e.g. EPDM, foamed urethane, etc.). With the conducting elastic material, the intermediate transfer rollers 6 can uniformly apply a high voltage to the intermediate transfer belt 7. In the present embodiment, a transfer electrode of roller type (intermediate transfer roller 6) is used. However, a transfer electrode of other types such as brush type may be also used.

As described above, electrostatic latent images on the photoreceptors 3 are made to be visible using the toners of the respective colors, so as to become individual toner images. Then, the toner images are superimposed one another on the intermediate transfer belt 7. In this way, the superimposed toner images are transported to a contact point at which the intermediate transfer belt 7 and a sheet transported by rotation of the intermediate transfer belt 7 come in contact, and transferred onto the sheet by a transfer roller 11 disposed at the point. In this case, the intermediate transfer belt 7 and the transfer roller 11 are pressured and contacted each other at a predetermined nip, while a voltage for transferring the toner image onto the sheet is applied to the transfer roller 11. The voltage is high and has a reverse polarity (+) with respect to a polarity (−) in which the toners are charged.

In order to gain the nip steadily, either one of the transfer roller 11 and the intermediate transfer belt driving roller 71 is made of hard material such as metal or the like, while the other one is made of soft material, i.e., an elastic roller or the like (elastic rubber roller, foamed resin roller, etc.).

Some toners remain on the intermediate transfer belt 7, such as a toner adhered to the intermediate transfer belt 7 when the intermediate transfer belt 7 and the photosensitive drums 3 come in contact, or a toner that was not transferred onto the sheet and remains on the intermediate transfer belt 7. Such toners are removed by the intermediate transfer belt cleaning unit 9, because the remained toners may be causes for color mixture in subsequent processes. The intermediate transfer belt cleaning unit 9 includes, for example, a cleaning blade which serves as a cleaning member and contacts the intermediate transfer belt 7. The intermediate transfer belt cleaning unit 9 comes in contact with a portion of the intermediate transfer belt 7, and at the portion, the intermediate transfer belt 7 is supported from its backside by the intermediate transfer belt following roller 72.

The paper feed tray 10, provided below an image formation section and the exposure unit 1, serves to hold sheets (e.g. recording paper sheets) to be used for image formation. On the other hand, the paper output tray 15, provided on the top of the image forming apparatus A, is where printed sheets are put with their front sides facing down.

Further, in the image forming apparatus A, the sheet transport path S is provided which serves to transport sheets from the paper feed tray 10 or from a manual paper feed tray 20 to the paper output tray 15 via the transfer section 11 and the fixing unit 12. From the paper feed tray 10 to the paper output tray 15 in the sheet transport path S, there are provided: the transfer section including pickup rollers 16, a resist roller 14, and the transfer roller 11; the fixing unit 12; transport rollers 25; and the like.

The transport rollers 25, provided along the sheet transport path S, are small rollers serving to facilitate and assist transport of sheets. The pickup rollers 16, disposed at the edges of the paper feed tray 10, serve as guiding rollers for transporting sheets to the sheet transport path S one by one. The resist roller 14 temporarily holds a sheet being transported on the sheet transport path S, and feeds the sheet to the transfer section at the timing of matching the leading edge of the sheet with the top edge of a toner image formed on a photosensitive drum.

The fixing unit 12 includes a heat roller 31, a pressure roller 32, and the like. The heat roller 31 and the pressure roller 32 rotate, while nipping a sheet therebetween. The heat roller 31 is controlled by a control section (not shown) so as to maintain a predetermined fixed temperature. The control section controls the heat roller 31 based on a detection signal supplied from a temperature sensor (not shown). Together with a pressure roller 32, the heat roller 31 fixes the sheet by thermo-compression bonding, and fuses, mixes, pressures and fixes the colored toner image transferred on the sheet so as to heat fix the image onto the sheet. This realizes heat fixing of the image onto the sheet. Further, the sheet on which the multi-colored toner image (toner image with colors) was fixed is transported by the transport rollers 25 to a reversed paper output path of the sheet transport path S, and outputted to the paper output tray 15 with the sheet inverted (with the multi-colored image facing down).

Described next is sheet transport operation through the sheet transport path S, including processes performed by the sections. As described above, the image forming apparatus A includes the paper feeding cassette 10 for holding sheets beforehand, and the manual paper feed tray 20 used in printing a few sheets and the like. For both of the paper feeding cassette 10 and the manual paper feed tray 20, the pickup rollers 16 (16-1 and 16-2) are provided, so that each of the pickup rollers 16 feeds sheets to the sheet transport path S one by one.

(For Single-Sided Printing)

A sheet fed from the paper feeding cassette 10 is transported up to the resist roller 14 by the transport roller 25-1 disposed on the sheet transport path S. Then, the sheet is outputted to the transfer section by the resist roller 14, at the timing of matching the leading edge of the sheet with the top edge of a toner image superimposed on the intermediate transfer belt 7. In the transfer section, the toner image is transferred, and fixed onto the sheet by the fixing unit 12. Further, the sheet is passed through the transport roller 25-2 and outputted from the paper output roller 25-3 to the paper output tray 15.

On the other hand, a sheet fed from the manual paper feed tray 20 is transported to the resist roller 14 by the transport rollers 25 (25-6, 25-5, and 25-4). In the subsequent path, the sheet is transported and outputted to the paper output tray 15 in a manner similar to the case where a sheet is fed from the paper feeding cassette 10.

(For Double-Sided Printing)

As to a sheet having had its one side printed and passed through the fixing unit 12, the bottom edge of the sheet is held by the paper output roller 25-3. Then, the sheet is rotated in a reversed direction to be guided to the transport rollers 25-7 and 25-8, undergone through the backside printing of the sheet, and outputted to the paper output tray 15.

Figure 3:
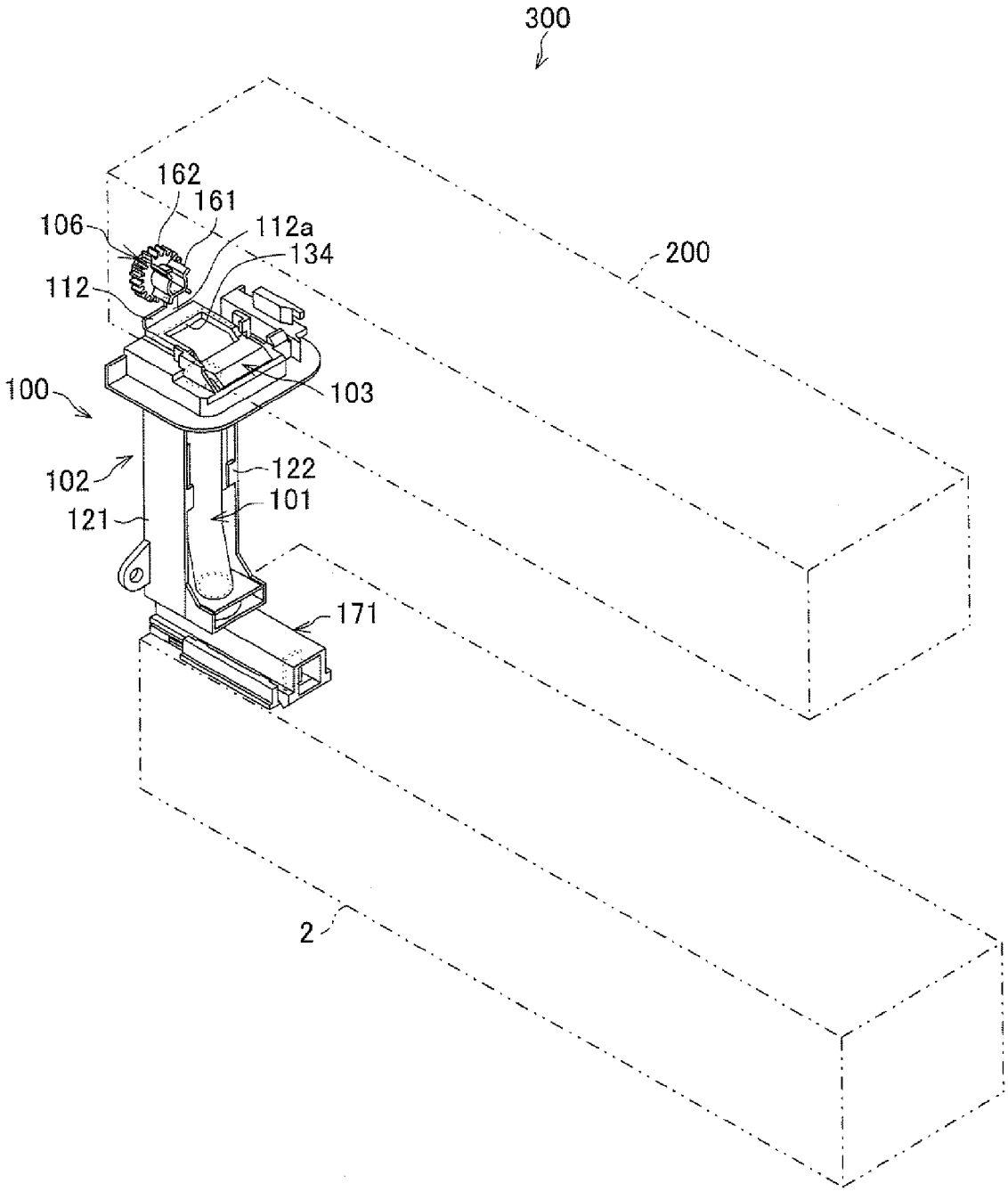
FIG. 3 is an oblique view illustrating a schematic structure of the toner supply device having the toner transport device illustrated in FIG. 1(*a*) and FIG. 1(*b*).

In FIG. 3, toner transport devices 100 are disposed on the developing devices 2. Further, on the toner transport devices 100, toner cartridges (toner replenishing devices) 200 are provided. The developing devices 2 and the toner cartridges 200 are connected by the toner transport devices 100, respectively. Further, toners stored in the toner cartridges 200 are supplied to the developing devices 2 via the toner transport devices 100, respectively.

FIG. 3 is a perspective view of a toner supply device 300. The toner supply device 300 includes a developing device 2, a toner transport device 100, and a toner cartridge 200. In order to simplify the structure of the toner transport device 100, FIG. 3 shows the developing device 2 and the toner cartridge 200 as rectangular prisms indicated by chain double-dashed lines. That is, in the present embodiment, the developing device 2 and the toner cartridge 200 may have conventionally known structures and functions.

In the present embodiment, the toner transport device 100, the toner cartridge 200, and the developing device 2 are configured to be in the form of horseshoe. This is because the intermediate transfer belt 7 moves between the toner transport device 100 and the developing device 2 as illustrated in FIG. 2.

Figure 1A:
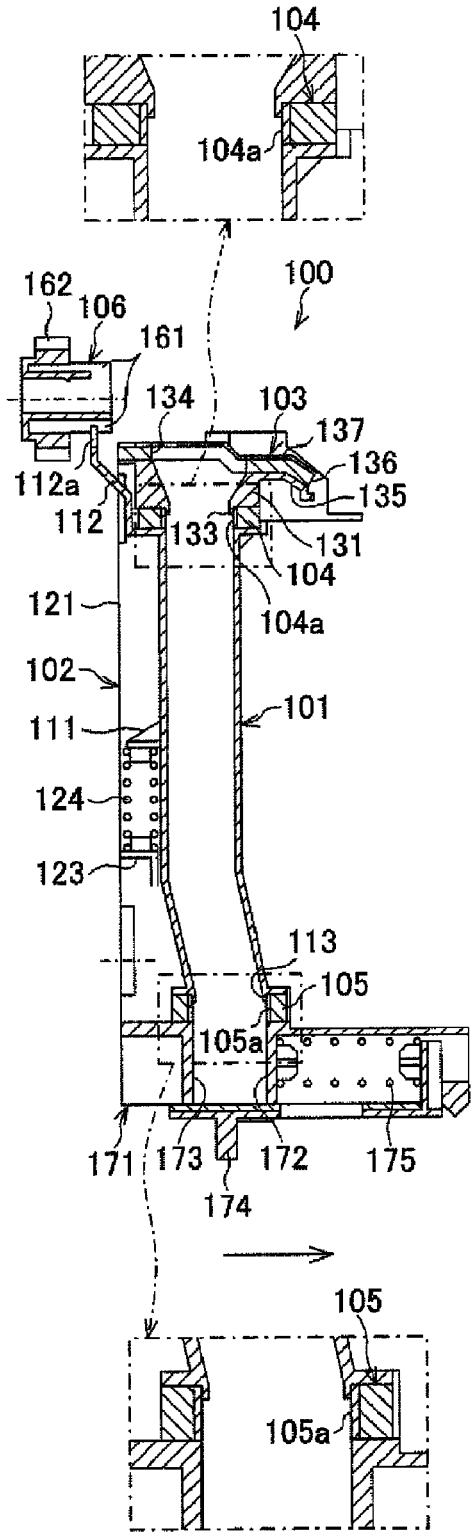
FIG. 1(*a*) and FIG. 1(*b*) are vertical cross-sectional views each of which illustrates a toner transport device of one embodiment of the present technology.
Figure 1B:
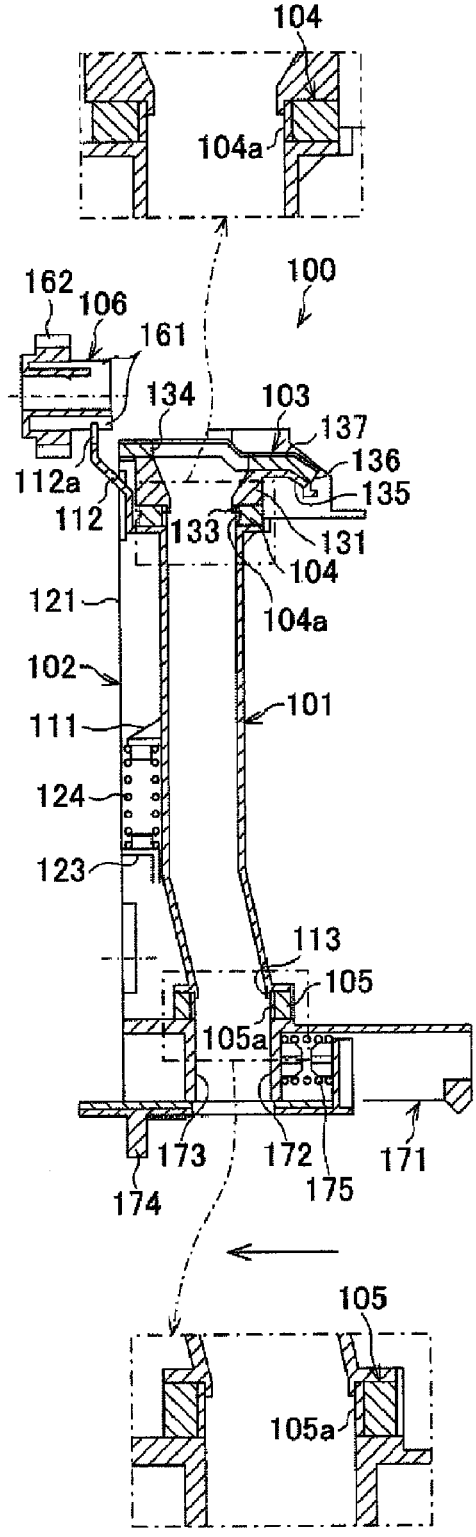
Figure 4:
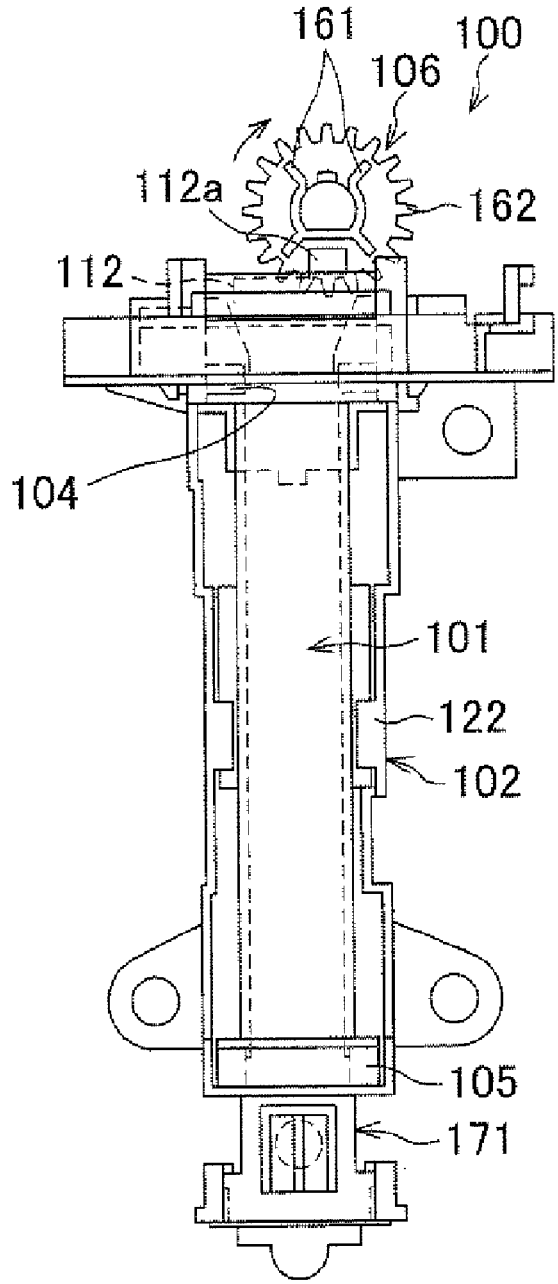
FIG. 4 is a front view of the toner transport device illustrated in FIG. 1(*a*) and FIG. 1(*b*).
Figure 5:
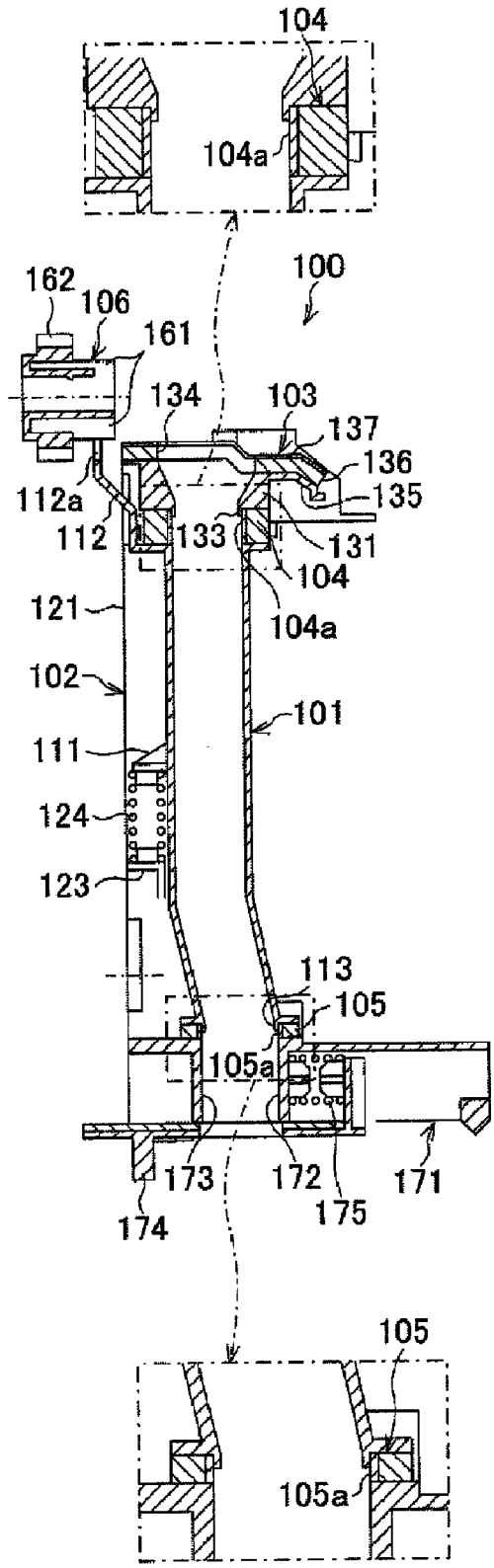
FIG. 5 is a vertical cross-sectional view illustrating a state in which a toner transport pipe is pushed downward by a rotator in the toner transport device illustrated in FIG. 1(*b*).
Figure 6:
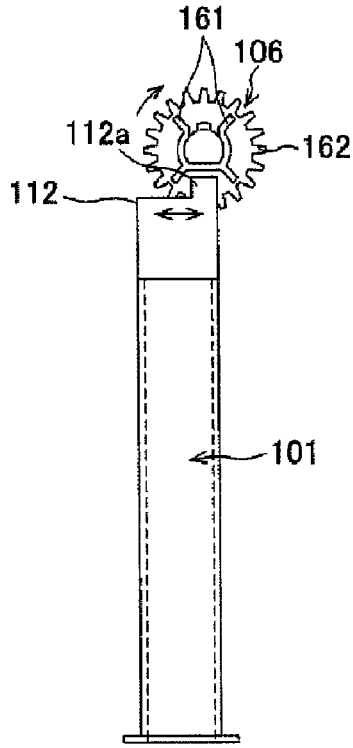
FIG. 6 is an explanatory drawing illustrating a state in which operation wings of the rotator are detached from a protruded tag section of the toner transport pipe in the toner transport device illustrated in FIG. 1(*a*) and FIG. 1(*b*).
Figure 7:
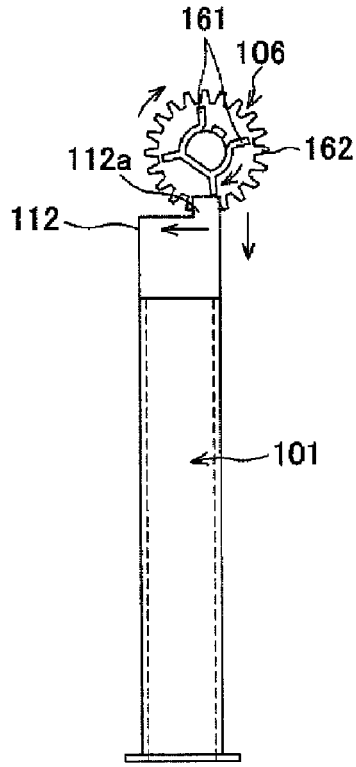
FIG. 7 is an explanatory drawing illustrating how the operation wings of the rotator drive the toner transport pipe to move downward and to vibrate in a horizontal direction in the toner transport device illustrated in FIG. 1(*a*) and FIG. 1(*b*).

FIG. 4 is a front view of the toner transport device 100, and FIGS. 1(*a*) and 1(*b*) are vertical cross-sectional views of the toner transport device 100 when viewed from the side. As illustrated in FIGS. 1(*a*) and 1(*b*), the toner transport device 100 includes a toner transport pipe (toner transport member) 101, a pipe supporting member (supporting member) 102, an upper foamed elastic member (elastic member, foamed elastic member) 104, a lower foamed elastic member (elastic member, foamed elastic member) 105, and a rotator (rotary motion and linear motion conversion mechanism) 106.

The toner transport pipe 101 is a member formed in a pipe shape, extending in the up-and-down direction. The toner transport pipe 101 contains a toner transport path, and is supported by the pipe supporting member 102 so as to be movable in the upward and downward directions. The pipe supporting member 102 covers the back of the toner transport pipe 101, and on the back of the toner transport pipe 101 is provided a spring stopper section 111. Further, on the top edge of the toner transport pipe 101 is provided a protruded tag section (rotary motion and linear motion conversion mechanism) 112. On the top of the protruded tag section 112 is provided an operating protrusion section 112*a* that is further protruded from a portion of the protruded tag section 112.

In the present embodiment, the toner transport pipe 101 serving as a toner transport path contains a round hollow area, and its inner wall has a smooth curved surface. Specifically, the inner wall is a smooth round surface having no concaves and protrusions where toner particles can remain.

The toner transport pipe 101 has a minimum internal diameter at its top end. The internal diameter of the toner transport pipe 101 gradually becomes large toward the downstream, so as to be maximum at its bottom end. In the present embodiment, the internal diameter is $\phi$9.5 mm at the top end and $\phi$10 mm at the bottom end. Due to the difference in the internal diameter between the top end and the bottom end, toner supplied from the top end is allowed to pass smoothly without remaining somewhere in the toner transport pipe 101, so as to easily reach the bottom end. In order to obtain such a functional capability, the difference in the internal diameter between the top end and the bottom end should be at least not less than $\phi$0.1 mm, preferably not less than $\phi$0.2 mm.

In the present embodiment, the toner transport pipe 101 is warped at its lower part in consideration of the internal configuration of the image forming apparatus A. That is, the shape of the toner transport pipe 101 is not limited to this and may be straight, for example.

In order to support the toner transport pipe 101 for its up and down movements, the pipe supporting member 102 includes an upper supporting section, a lower supporting section, and an intermediate supporting section 121 disposed between the upper supporting section and the lower supporting section. The upper supporting section includes a supporting plate section 135 and a guiding pipe section 131, and the lower supporting section includes a transport pipe receiving section 171 as illustrated in FIGS. 1(*a*) and 1(*b*).

As illustrated in FIG. 3, the intermediate supporting section 121 is, for example, in a box shape. The intermediate supporting section 121 has supporting protrusion sections 122 protruded toward the toner transport pipe 101. The supporting protrusion sections 122 are provided, for example, in the vicinity of the middle part of the intermediate supporting section 121 in the up-and-down direction. As such, since the toner transport pipe 101 is partially supported by the supporting protrusion sections 122 at the vicinity of its middle part, the toner transport pipe 101 is allowed to move up and down and vibrate from side to side.

As illustrated in FIGS. 1(*a*) and 1(*b*), a spring stopper section 123 is provided on an internal surface of the intermediate supporting section 121. The spring stopper section 123, positioned on the internal surface facing the back of the toner transport pipe 101, is located below the spring stopper section 111 disposed on the toner transport pipe 101. Further, a coil spring (biasing member, rotary motion and linear motion conversion mechanism) 124 is disposed between the spring stopper sections 111 and 123. The coil spring serving as an elastic member is a compression spring.

The upper supporting section of the pipe supporting member 102 includes the supporting plate section 135 in its upper part and the guiding pipe section 131 in its lower part. The guiding pipe section 131 serves to guide toner, supplied through a toner supply port 134 of a toner cartridge mounting section 103, to the toner transport pipe 101. Therefore, an internal diameter of the guiding pipe section 131 at its bottom end is set so as to correspond to an internal diameter of the toner transport pipe 101.

The bottom end of the guiding pipe section 131 is connected to the top end of the toner transport pipe 101 via the upper foamed elastic member 104. The upper foamed elastic member 104 contains a toner passage having a diameter corresponding to an internal diameter of the toner transport pipe 101, and has a ring structure so as to prevent toner leakage to the outside. A top surface of the upper foamed elastic member 104 is adhered to a bottom end surface of the guiding pipe section 131, and a bottom surface of the upper foamed elastic member 104 is adhered to a top end surface of the toner transport pipe 101.

In order to simplify the positioning of the upper foamed elastic member 104 onto the bottom end surface, a positioning protrusion section (positioning section) 133 for positioning the upper foamed elastic member 104 is provided on the bottom end surface (adhesive surface) of the guiding pipe section 131. The positioning protrusion section 133 is protruded downward along an inner wall of the guiding pipe section 131. The shape of the positioning protrusion section 133 is not particularly limited and may be any shape that allows the positioning of the upper foamed elastic member 104. For example, the positioning protrusion section 133 may be formed in a ring shape so as to extend along the inner wall of the guiding pipe section 131, or may partially have protrusion(s) along the inner wall of the guiding pipe section 131.

Further, in the present embodiment, the positioning protrusion section 133 is provided on the bottom end surface (adhesive surface) of the guiding pipe section 131. However, the positioning protrusion section 133 may be provided on the adhesive surface on the top end surface of the toner transport pipe 101, or may be formed on the both adhesive surfaces if possible.

On the supporting plate section 135 constituting the upper supporting section of the pipe supporting member 102, a toner cartridge mounting section (toner replenishing device mounting section) 103 is provided. Through the toner cartridge mounting section 103, a toner supply port 134 is provided so as to supply toner into the guiding pipe section 131. The toner cartridge mounting section 103, formed in a plate shape, includes a foamed elastic member 136 and a mylar film 137 which are stacked in this order.

When the toner cartridge 200 is inserted onto or removed from the toner transport device 100, the toner cartridge 200 slides on the toner cartridge mounting section 103. Thus, in order to prevent abrasion of the foamed elastic member 136 and facilitate smooth sliding of the toner cartridge 200, the mylar film 137 is provided on the foamed elastic member 136 as noted above. Note that, when the toner cartridge 200 is inserted onto the toner transport device 100, a toner exhaust port of the toner cartridge device 200 (not shown) fits the toner supply port 134 of the toner transport device 100.

Further, instead of the mylar film 137, for example, a PET (polyethylene terephthalate) film or a PTFE (polytetrafluoroethylene) film may be used. Specifically, the foamed elastic member 136 preferably has thereon a layer required to have a frictional coefficient of less than that of a surface of the foamed elastic member 136 when the toner cartridge 200 is slid and inserted. It is more preferable that the layer have a high abrasion resistance.

The bottom end of the toner transport pipe 101 is connected to the transport pipe receiving section 171 of the pipe supporting member 102 via the lower foamed elastic member 105. The lower foamed elastic member 105 contains a toner passage having a diameter corresponding to an internal diameter of the toner transport pipe 101, and has a ring structure so as to prevent toner leakage to the outside. A top surface of the lower foamed elastic member 105 is adhered to the bottom end surface of the toner transport pipe 101, and a bottom surface of the lower foamed elastic member 105 is adhered to a top surface of the transport pipe receiving section 171.

As in the case of the bottom end surface of the guiding pipe section 131, the bottom end surface (adhesive surface) of the toner transport pipe 101 is provided with a positioning protrusion section (positioning section) 113, in order to simplify the positioning of the lower foamed elastic member 105 to the bottom end surface of the toner transport pipe 101. The positioning protrusion section 113 is protruded downward along the inner wall of the toner transport pipe 101. Like the positioning protrusion section 133, the shape of the positioning protrusion section 113 is not particularly limited and may be any shape that allows the positioning of the lower foamed elastic member 105. For example, the positioning protrusion section 113 may be formed in a ring shape so as to extend along the inner wall of the guiding pipe section 101, or may partially have protrusion(s) along the inner wall of the toner transport pipe 101.

Further, in the present embodiment, the positioning protrusion section 113 is provided on the bottom end surface (adhesive surface) of the toner transport pipe 101. However, the positioning protrusion section 113 may be provided on the adhesive surface of the transport pipe receiving section 171, or may be formed on the both adhesive surfaces if possible.

The transport pipe receiving section 171 contains a toner exhaust passage (toner passage) 172, whose bottom end serves as a toner exhaust port 173 led to the developing device 2. The toner exhaust port 173 has a shutter 174 capable of sliding. The shutter 174 is biased by an elastic member, i.e., a coil spring 175, provided inside the transport pipe receiving section 171. When the toner transport device 100 is not mounted on the developing device 2, the toner transport device 100 is in a closed state as illustrated in FIG. 1(*a*). On the other hand, when the toner transport device 100 is mounted on the developing device 2, in response to the movement of the toner transport device 100 being inserted onto the developing device 2, the shutter 174 is pushed and moved by the developing device 2, thereby becoming in an opened state as illustrated in FIG. 1(*b*).

The upper foamed elastic member 104 and the lower foamed elastic member 105 can be deformed with the application of external pressure. When the external pressure is released, the upper foamed elastic member 104 and the lower foamed elastic member 105 can return in their initial shapes. As such, the toner transport pipe 101 is connected to the toner cartridge mounting section 103 via the upper foamed elastic member 104, while being connected to the transport pipe receiving section 171 of the pipe supporting member 102 via the lower foamed elastic member 105. With the above structure, between the toner cartridge mounting section 103 and the transport pipe receiving section 171, the toner transport pipe 101 can move up and down, and from side to side (vibrates in the horizontal direction).

The upper foamed elastic member 104 and the lower foamed elastic member 105 are made of, for example, foamed urethane resin. As the foamed elastic member, there are (i) a continuous-bubble foamed elastic member whose bubbles are interconnected and (ii) a single-bubble foamed elastic member whose bubbles are separated from one another. Any of the foamed elastic members may be used.

It should be noted that, in the upper and lower foamed elastic members 104 and 105, a wall surface of the toner passage of the main body made of foamed urethane resin or the like is coated with resin layers 104*a* and 105*a*, which do not allow toner to pass therethrough, as illustrated in FIGS. 1(*a*) and 1(*b*).

Each of the resin layers 104*a* and 105*a* can be formed, for example, by applying a water-soluble urethane resin to the wall surface of the toner passage, at least by applying or flowing the water-soluble urethane resin to bubbles of the wall surface of the toner passage.

It is preferable that the resin layers 104*a* and 105*a* are evenly formed on the wall surface of the toner passage. In case of forming the resin layers 104*a* and 105*a* by using the water-soluble urethane resin, the thickness thereof is set to 0.1 to 1.0 mm, thereby effectively preventing toner from coming into the bubbles of the wall surface of the toner passage of the main body made of foamed urethane or the like. Further, it is more preferable to set the thickness to 0.2 to 0.5 mm. This prevents toner from coming into the bubbles of the wall surface of the toner passage without fail.

In this manner, the upper foamed elastic member 104 and the lower elastic member 105 are arranged so that the wall surface of the toner passage of the main body made of foamed urethane resin or the like is coated with the resin layers 104*a* and 105*a* which do not allow toner to pass therethrough. According to this arrangement, toner transported through the toner transport path of the toner transport pipe 101 does not come into the bubbles of the wall surface of the toner passage in the upper foamed elastic member 104 and the lower foamed elastic member 105.

The toner does not come into the bubble, so that contractility of the upper foamed elastic member 104 and the lower foamed elastic member 105 is favorably kept. Thus, the upper foamed elastic member 104 and the lower foamed elastic member 105 do not hamper upward-and-downward vibration of the toner transport pipe 101, and oscillation caused by the upward-and-downward vibration of the toner transport pipe can be absorbed while keeping sufficient stroke. As a result, the sealing property in the joint section is secured, so that it is possible to properly prevent the toner leakage.

Further, due to the arrangement in which toner does not come into the bubbles of the wall surface of the toner passage in the upper foamed elastic member 104 and the lower foamed elastic member 105, even if the upper foamed elastic member 104 and the lower foamed elastic member 105 have continuous bubbles, expanding and contracting operations of the upper foamed elastic member 104 and the lower foamed elastic member 105 at the time of the upward-and-downward vibration of the toner transport pipe 101 do not cause the toner to issue from the toner transport path to the outside.

Further, in case where a synthetic leather is applied with a double face adhesive tape as in the elastic member disclosed in the aforementioned patent document 4, one member may deviate from the other member or one member may drop off from the other member. However, the elastic member is made of the water-soluble urethane resin, so that the member neither deviates nor drops off.

On the other hand, as to the foamed polyurethane resin constituting the main body in the upper foamed elastic member 104 and the lower foamed elastic member 105, its proper density is 50 to 120 kg/m$^3$. As the foamed polyurethane resin, it is possible to use "Microcell" (product name: registered trademark), product of Bridgestone.

If the density is less than 50 kg/m$^3$, the water-soluble urethane resin permeates the whole bubbles, so that the polyurethane resin becomes hard. This hampers the upward-and-downward vibration of the toner transport pipe 101. Further, if the density exceeds 120 kg/m$^3$, the polyurethane resin itself becomes hard. This hampers the upward-and-downward vibration of the toner transport pipe 101 likewise. Further, if the density exceeds 140 kg/m$^3$, the water-soluble urethane resin hardly permeates, so that it is difficult to form an even resin layer.

Further, as to the density of the foamed polyurethane resin constituting the main body in the upper foamed elastic member 104 and the lower foamed elastic member 105, it is more preferable that the density is 60 to 110 kg/m$^3$. This is because the water-soluble urethane resin properly permeates and sufficient contractibility is obtained by setting the density in this manner.

Further, the resin layers 104*a* and 105*a* can be formed, for example, by heating a surface of the foamed polyurethane resin or the like constituting the main body in the upper foamed elastic member 104 and the lower foamed elastic member 105.

As described above, the resin layers 104*a* and 105*a* serve to prevent toner from coming into the bubbles of the wall surface of the toner passage in the upper foamed elastic member 104 and the lower foamed elastic member 105. Thus, by covering the bubbles of the surface with the resin layers obtained by heating the surface of the foamed polyurethane resin or the like, it is possible to easily realize the rein layers which do not allow toner from passing therethrough. Further, according also to this arrangement, the member neither deviates nor drops off.

Further, as in the toner transport pipe 101, it is preferable to arrange the foamed elastic member 104 so as to have a minimum internal diameter at its top end and so that the internal diameter of the toner transport pipe 101 gradually becomes large toward the downstream. Further, it is preferable to arrange an internal diameter of the bottom end is identical to an internal diameter of a top end of the toner transport pipe 101 so as to have no level difference with respect to the top end of the toner transport pipe 101. Likewise, as in the toner transport pipe 101, it is preferable to arrange the lower foamed elastic member 105 so as to have a minimum internal diameter at its top end and so that the internal diameter of the toner transport pipe 101 gradually becomes large toward the downstream. Further, it is preferable to arrange an internal diameter of the bottom end is identical to an internal diameter of a top end of the transport pipe receiving section 171 so as to have no level difference with respect to the top end of the transport pipe receiving section 171.

The rotator 106 is disposed in the vicinity of a top end of the protruded tag section 112 of the toner transport pipe 101 so that its axis direction is perpendicular to an up-and-down direction of the toner transport pipe 101. The rotator 106 has transport pipe operation wings 161 provided on the protruded tag section 112 in the axis direction, and a gear 162 is formed on the rotator 106 so as to be positioned opposite to the transport pipe operation wings 161 in the axis direction.

In the present embodiment, the rotator 106 rotates in response to a rotational driving force of a stirring transport member for transporting toner while stirring the toner in the toner cartridge 200. Thus, the gear 162 of the rotator 106 is engaged with other gear (not shown) for transmitting the rotational driving force. Note that, the rotator 106 is not limited to this arrangement but may be arranged so that the rotator 106 is driven by an independent driving source, e.g., a special motor. Further, the rotator 106 drives the toner transport pipe 101, so that the rotator 106 belongs to the toner transport device 100 in view of a function, but the rotator 106 may be provided on the toner cartridge 200 in view of a structure.

In the present embodiment, four transport pipe operation wings 161 are provided on the rotator 106 so as to be substantially evenly dispersed in a peripheral direction of the rotator 106. Note that, the number of the transport pipe operation wings 106 is not particularly limited. Each transport pipe operation wing 161 rotates with rotation of the rotator 106 and acts on the toner transport pipe 101 as follows.

The transport pipe operation wing 161 first comes into contact with the operating protrusion section 112*a* of the protruded tag section 112 in the toner transport pipe 101, and an external end of the transport pipe operation wing 161 slides on a top of the operating protrusion section 112*a* so as to push the operating protrusion section 112*a* down so that the toner transport pipe 101 moves downward, and then the external end deviates from the top of the operating protrusion section 112*a*, so that the toner transport pipe 101 is returned to its original position. A series of these operations causes the toner transport pipe 101 to vibrate in upward and downward directions.

Further, there is carried out the series in which the transport pipe operation wing 161 comes into contact with the operating protrusion section 112*a* of the protruded tag section 112 in the toner transport pipe 101 and the external end of the transport pipe operation wing 161 slides on the top of the operating protrusion section 112*a* and then the external end deviates from the top, so that the protruded tag section 112, i.e., the toner transport pipe 101 horizontally vibrates in response to a lateral force exerted by the transport pipe operation wing 161.

Thus, the transport pipe operation wing 161 of the rotator 106 acts on the operating protrusion section 112*a* of the protruded tag section 112, so that the toner transport pipe 101 vibrates in upward and downward directions and vibrates in horizontal direction.

In the aforementioned arrangement, the toner supply device 300 is arranged so that the toner cartridge 200 is provided on the toner transport device 100 and the developing device 2 is provided under the toner transport device 100. Under such condition that these three devices are provided on one another, a rotational driving force of the stirring transport member provided in the toner cartridge 200 is transmitted to the rotator 106 of the toner transport device 100, so that the rotator 106 can rotate.

Note that, if the rotator 106 is rotated by using the driving force exerted to the stirring transport member and the rotation causes the toner transport pipe 101 to move as in the present embodiment, this gives a load to the driving source of the stirring transport member, so that this may have any influence on the operation for rotating the stirring transport member. However, such an influence on the operation for rotating the stirring transport member does not result in any bad influence on quality of an image formed by the image forming apparatus A including the toner supply device 300.

The operation of the stirring transport member provided in the toner cartridge 200 causes toner contained in the toner cartridge 200 to be poured into the toner supply port 134 of the toner cartridge mounting section 103 of the toner transport device 100. The toner passes through the guiding pipe section 131, and further passes through the toner transport pipe 101 and the toner exhaust passage 172, and then is supplied from the toner exhaust port 173 to the developing device 2. At this time, the developing device 2 is mounted on the toner transport device 100, so that the shutter 174 opens the toner exhaust port 173.

In the toner supply device 300, when toner is replenished from the toner cartridge 200 via the toner transport device 100 to the developing device 2 in the foregoing manner, the rotator 106 rotates in response to a driving force exerted to the stirring transport member of the toner cartridge 200. Thus, the transport pipe 161 of the rotator 106 drives the operating protrusion section 112*a* of the toner transport pipe 101, i.e., drives the toner transport pipe 101, so that the toner transport pipe 101 oscillates up and down and vibrates side to side. Thus, it is possible to prevent such a problem that toner retains in the toner transport pipe 101 and is further solidified which results in toner transport failure.

As described above, in the toner transport device 100, in order that the toner transport pipe 101 can move in up and down and can vibrate side to side, (i) the upper foamed elastic member 104 provided between the toner transport pipe 101 and the toner cartridge mounting section 103 and (ii) the lower foamed elastic member 105 provided between the toner transport pipe 101 and the transport pipe receiving section 171 are arranged so that the wall surface of the toner passage formed on the main body made of foamed polyurethane resin is coated with the resin layers 104*a* and 105*a* which do not allow toner to pass therethrough.

As a result, toner does not retain and is not solidified in the upper foamed elastic member 104 and the lower foamed elastic member 105, so that the upper foamed elastic member 104 and the lower foamed elastic member 105 freely expand or contract, which allows the toner transport pipe 101 to vibrate in upward and downward directions. Thus, it is possible to absorb oscillation caused by the upward-and-downward vibration of the toner transport pipe 101 while keeping sufficient stroke. As a result, the sealing property in the joint section is secured, thereby properly preventing toner leakage.

Further, toner does not come into the bubbles of the upper foamed elastic member 104 and the lower foamed elastic member 105. Thus, even if the upper foamed elastic member 104 and the lower foamed elastic member 105 have continuous bubbles, expanding and contracting operations of the upper foamed elastic member 104 and the lower foamed elastic member 105 at the time of the upward-and-downward vibration of the toner transport member do not cause the toner to issue from the toner transport path to the outside.

Incidentally, the present embodiment described, as the most favorable example, the arrangement in which the upper foamed elastic member 104 and the lower foamed elastic member 105 are provided in an upper portion and a lower portion of the toner transport pipe 101, but it may be so arranged that only either the upper foamed elastic member 104 or the lower foamed elastic member 105 is provided, or it may be so arranged that foamed elastic members are provided respectively on upper and lower joint sections of the toner transport pipe 101 but a resin layer for covering the wall surface of the toner passage is formed on only one of the foamed elastic members.

In this case, it is preferable to form the resin layer on the elastic member positioned on the lower side of the toner transport pipe 101. This is because toner is likely to retain in the bottom of the toner transport pipe 101 due to its free fall in the toner transport path disposed in an up-and-down direction. The arrangement in which the resin layer having a high toner sealing property is provided at least on the lower side of the toner transport pipe 101 effectively prevents toner leakage in the joint section.

As described above, the present technology transports toner supplied from a toner replenishing device provided above the toner transport device to a developing device provided below the transport device, and the toner transport device includes: a toner transport member, internally having a toner transport path, which is disposed so that the toner transport path extends in an up-and-down direction and which vibrates in upward and downward directions; and an elastic member, made of a deformable foamed material, which is disposed on at least either an upper joint section or a lower joint section of the toner transport member and which internally has a toner passage for allowing the toner transported to/from the toner transport path to pass therethrough, wherein a wall surface of the toner passage in the elastic member is coated with a resin layer which does not allow the toner to pass therethrough.

With this arrangement, the toner transport member is vibrated in the upward and downward directions, so that toner passes through the toner transport path of the toner transport member without any retention. As a result, it is possible to prevent retention and solidification of toner in the toner transport path.

Further, the elastic member disposed on at least either the upper joint section or the lower joint section of the toner transport member properly seals the joint section of the toner transport member without hampering upward-and-downward vibration of the toner transport member.

Particularly, with the aforementioned arrangement, the wall surface of the toner passage of the elastic member is coated with the resin layer which does not allow the toner to pass therethrough, so that the toner transported through the toner transport path does not come into bubbles of the elastic member made of foamed material.

The toner does not come into the bubbles, so that contractility of the elastic member is favorably kept. Thus, the elastic member can absorb oscillation at the time of the upward-and-downward vibration of the toner transport member while keeping sufficient stroke. As a result, the joint section is firmly sealed, so that it is possible to properly prevent toner leakage.

Further, toner does not come into the bubbles, so that even an elastic member containing continuous bubbles interconnected to one another does not allow toner to issue from the toner transport path at the time of expanding and contracting operations of the elastic member which are caused by the upward-and-downward vibration of the toner transport member.

As a result, it is possible to provide (i) a toner transport device which can properly prevent retention and solidification of toner in the toner transport path by upward-and-downward vibration of the toner transport member and can properly prevent toner from leaking from the toner transport device and (ii) an image forming apparatus having the toner transport device.

Further, it is most preferable that the elastic member is disposed on each of the upper side and the lower side of the toner transport member, but it is preferable to provide the elastic member at least on the lower side.

In the toner transport path disposed in the up-and-down direction, toner is likely to retain in the bottom of the toner transport member due to its free fall. Thus, by disposing at least on the lower side the elastic member whose toner sealing property is high, it is possible to effectively prevent toner leakage in the joint section.

The toner transport device of the present technology can be arranged so that the elastic member is made of a foamed polyurethane resin for example.

The polyurethane resin is excellent in elasticity, abrasion resistance, stability, and the like. Thus, by using the polyurethane resin, it is possible to carry out upward-and-downward vibration of the toner transport member for a long time with stability.

The toner transport of the present technology can be arranged so that the resin layer is made of a water-soluble urethane resin.

The water-soluble urethane resin is likely to permeate a polyurethane resin, so that a surface of the resin layer can be evenly coated. With this arrangement, it is possible to easily realize the resin layer of the present technology which does not allow toner to pass therethrough. Moreover, in case of an elastic member applied to a synthetic leather with a double-face adhesive tape as in the elastic member disclosed by the aforementioned patent document 4, two members may deviate from each other or one member may drop off from the other member. However, by using the water-soluble urethane resin in forming the resin layer, it is possible to overcome the problems such as deviation and dropping of the members.

The toner transport device of the present technology can be arranged so that the resin layer is formed by heating a surface of the elastic member.

As described above, the resin layer serves to prevent toner from coming into bubbles of the elastic member. Thus, by covering the bubbles of the surface of the elastic member with the resin layer obtained by heating the surface, it is possible to easily realize the resin layer which does not allow toner to pass therethrough. Further, also in this case, there is no problems such as the deviation and the dropping as in the arrangement in which the resin layer is made of the water-soluble urethane resin.

The embodiments and concrete examples of implementation discussed in the foregoing detailed explanation serve solely to illustrate the technical details, which should not be narrowly interpreted within the limits of such embodiments and concrete examples, but rather may be applied in many variations, provided such variations do not exceed the scope of the patent claims set forth below.

What is claimed is:

1. A toner transport device, transporting toner supplied from a toner replenishing device provided above the toner transport device to a developing device provided below the transport device, said toner transport device comprising:

a toner transport member, internally having a toner transport path, which is disposed so that the toner transport path extends in an up-and-down direction and which vibrates in upward and downward directions; and an elastic member, made of a deformable foamed material, which is disposed on at least either an upper joint section or a lower joint section of the toner transport member and which internally has a toner passage for allowing the toner transported to/from the toner transport path to pass therethrough, wherein a wall surface of the toner passage in the elastic member is coated with a resin layer which does not allow the toner to pass therethrough, and wherein the elastic member is made of a foamed polyurethane resin and a density of the polyurethane resin is 50 kg/m$^3$ to 120 kg/m$^3$.

2. The toner transport device as set forth in claim 1, wherein the resin layer is formed by heating a surface of the elastic member.

3. The toner transport device as set forth in claim 1, wherein:

the toner transport member has a pipe shape and internally has a cross-sectionally round hollow serving as the toner transport path, and the toner passage in the elastic member has a diameter corresponding to an internal diameter of the toner transport member.

4. An image forming apparatus, comprising a toner transport device which transports toner supplied from a toner replenishing device provided above the toner transport device to a developing device provided below the transport device, said toner transport device including:

a toner transport member, internally having a toner transport path, which is disposed so that the toner transport path extends in an up-and-down direction and which vibrates in upward and downward directions; and an elastic member, made of a deformable foamed material, which is disposed on at least either an upper joint section or a lower joint section of the toner transport member and which internally has a toner passage for allowing the toner transported to/from the toner transport path to pass therethrough, wherein a wall surface of the toner passage in the elastic member is coated with a resin layer which does not allow the toner to pass therethrough, and wherein the elastic member is made of a foamed polyurethane resin and a density of the polyurethane resin is 50 kg/m$^3$ to 120 kg/m$^3$.

5. A toner transport device, transporting toner supplied from a toner replenishing device provided above the toner transport device to a developing device provided below the transport device, said toner transport device comprising:

a toner transport member, internally having a toner transport path, which is disposed so that the toner transport path extends in an up-and-down direction and which vibrates in upward and downward directions; and an elastic member, made of a deformable foamed material, which is disposed on at least either an upper joint section or a lower joint section of the toner transport member and which internally has a toner passage for allowing the toner transported to/from the toner transport path to pass therethrough, wherein a wall surface of the toner passage in the elastic member is coated with a resin layer which does not allow the toner to pass therethrough, and wherein the resin layer is made of a water-soluble urethane resin.

6. The toner transport device as set forth in claim 5, wherein a thickness of the water-soluble urethane resin is 0.1 mm to 1.0 mm.

7. A toner transport device, transporting toner supplied from a toner replenishing device provided above the toner transport device to a developing device provided below the transport device, said toner transport device comprising:

a toner transport member, internally having a toner transport path, which is disposed so that the toner transport path extends in an up-and-down direction and which vibrates in upward and downward directions; and an elastic member, made of a deformable foamed material, which is disposed on at least either an upper joint section or a lower joint section of the toner transport member and which internally has a toner passage for allowing the toner transported to/from the toner transport path to pass therethrough, wherein a wall surface of the toner passage in the elastic member is coated with a resin layer which does not allow the toner to pass therethrough, and wherein the resin layer is formed by heating a surface of the elastic member.

* * * * *